US011815076B2

(12) United States Patent
Morris

(10) Patent No.: US 11,815,076 B2
(45) Date of Patent: Nov. 14, 2023

(54) ENGAGEMENT AND DISENGAGEMENT WITH EXTERNAL GEAR BOX STYLE PUMPS

(71) Applicant: Typhon Technology Solutions (U.S.), LLC, The Woodlands, TX (US)

(72) Inventor: Jeffrey G. Morris, The Woodlands, TX (US)

(73) Assignee: TYPHON TECHNOLOGY SOLUTIONS (U.S.), LLC, The Woodlands, TX (US)

( * ) Notice: Subject to any disclaimer, the term of this patent is extended or adjusted under 35 U.S.C. 154(b) by 215 days.

(21) Appl. No.: 16/525,373

(22) Filed: Jul. 29, 2019

(65) Prior Publication Data

US 2020/0040878 A1 Feb. 6, 2020

Related U.S. Application Data

(60) Provisional application No. 62/786,174, filed on Dec. 28, 2018, provisional application No. 62/715,165, filed on Aug. 6, 2018.

(51) Int. Cl.
*F04B 23/04* (2006.01)
*E21B 43/26* (2006.01)
(Continued)

(52) U.S. Cl.
CPC ..... *F04B 23/04* (2013.01); *E21B 43/26* (2013.01); *F04B 9/02* (2013.01); *F04B 17/03* (2013.01); *F04B 17/06* (2013.01); *F04B 49/02* (2013.01)

(58) Field of Classification Search
CPC .... F04B 9/00; F04B 9/02; F04B 17/03; F04B 17/05; F04B 17/06; F04B 23/04;
(Continued)

(56) References Cited

U.S. PATENT DOCUMENTS 4,118,151 A 10/1978 Murakami et al.
8,789,601 B2 7/2014 Broussard
(Continued)

FOREIGN PATENT DOCUMENTS

AR 092923 A1 5/2015
AR 104823 A2 8/2017
(Continued)

OTHER PUBLICATIONS

Author: Carlyle Johnson Title: Air / Hydraulic / Pneumatic Brake and Clutch Actuation Date published: Oct. 26, 2013 Date accessed: Jul. 31, 2021 Link: https://web.archive.org/web/20131026025445/https://www.cjmco.com/technical-info/actuation/pneumatic-hydraulically-actuated-clutches-brakes.shtml (Year: 2013).*
(Continued)

*Primary Examiner* — Charles G Freay
*Assistant Examiner* — Chirag Jariwala
(74) *Attorney, Agent, or Firm* — FENWICK & WEST LLP

(57) ABSTRACT

A system and a method for producing fracturing fluid, comprising: engaging an engagement coupling attached to one end of a gear box dual shaft to a gear box connector of an external gear box, wherein the external gear box is part of a pump; rotating the gear box dual shaft to drive the pump after engaging the engagement coupling with the gear box connector; disengaging the engagement coupling from the gear box connector; and rotating the gear box dual shaft without driving the pump after disengaging the engagement coupling with the gear box connector.

26 Claims, 8 Drawing Sheets

(51) Int. Cl.

| | |
|---|---|
| ***F04B 17/03*** | (2006.01) |
| ***F04B 9/02*** | (2006.01) |
| ***F04B 17/06*** | (2006.01) |
| ***F04B 49/02*** | (2006.01) |

(58) Field of Classification Search

CPC ..... F04B 23/06; F04B 2201/124; F04B 2201/1241; F04B 15/00; F04B 15/02; F04B 17/00; F04B 23/00; F04B 23/02; F04B 23/025; E21B 43/26; E21B 43/2607

USPC ..... 417/410.1, 410.15

See application file for complete search history.

(56) References Cited

U.S. PATENT DOCUMENTS

| | | | | |
|---|---|---|---|---|
| 9,121,257 | B2 | 9/2015 | Coli et al. | |
| 9,140,110 | B2 | 9/2015 | Coli et al. | |
| 9,395,049 | B2 | 7/2016 | Vicknair | |
| 9,475,020 | B2 | 10/2016 | Coli et al. | |
| 9,475,021 | B2 | 10/2016 | Coli et al. | |
| 9,534,473 | B2 | 1/2017 | Morris et al. | |
| 9,562,420 | B2 | 2/2017 | Morris et al. | |
| 9,650,879 | B2 | 5/2017 | Broussard et al. | |
| 9,945,365 | B2 | 4/2018 | Hernandez | |
| 10,107,084 | B2 | 10/2018 | Coli et al. | |
| 10,107,085 | B2 | 10/2018 | Coli et al. | |
| 10,221,668 | B2 | 3/2019 | Coli et al. | |
| 10,227,855 | B2 | 3/2019 | Coli et al. | |
| 2009/0068031 | A1* | 3/2009 | Gambier | F04B 47/02 417/364 |
| 2009/0084558 | A1 | 4/2009 | Bloom | |
| 2009/0092510 | A1* | 4/2009 | Williams | F04B 15/02 417/521 |
| 2011/0236225 | A1 | 9/2011 | Leugemors et al. | |
| 2011/2086858 | | 11/2011 | England et al. | |
| 2012/0063926 | A1* | 3/2012 | Grosskopf | F04B 39/14 417/223 |
| 2012/0244020 | A1* | 9/2012 | Heinrichs | F04B 47/02 417/313 |
| 2014/0096974 | A1 | 4/2014 | Coli et al. | |
| 2014/0150437 | A1 | 6/2014 | Norrick et al. | |
| 2015/0068724 | A1 | 3/2015 | Coli et al. | |
| 2015/0078924 | A1 | 3/2015 | Zhang et al. | |
| 2015/0300145 | A1 | 10/2015 | Coli et al. | |
| 2015/0314255 | A1 | 11/2015 | Coli et al. | |
| 2015/0377318 | A1* | 12/2015 | Byrne | F04B 53/006 700/282 |
| 2016/0084321 | A1* | 3/2016 | Mihajlovic | F16D 25/0632 192/66.22 |
| 2016/0177675 | A1 | 6/2016 | Morris et al. | |
| 2016/0208593 | A1 | 7/2016 | Coli et al. | |
| 2016/0208594 | A1 | 7/2016 | Coli et al. | |
| 2016/0326855 | A1 | 11/2016 | Coli et al. | |
| 2016/0369609 | A1* | 12/2016 | Morris | F04B 17/06 |
| 2017/0036178 | A1 | 2/2017 | Coli et al. | |
| 2017/0037718 | A1 | 2/2017 | Coli et al. | |
| 2017/0104389 | A1 | 4/2017 | Morris et al. | |
| 2017/0211569 | A1* | 7/2017 | Urdaneta | F04B 51/00 |
| 2017/0259227 | A1 | 9/2017 | Morris et al. | |
| 2017/0284484 | A1 | 10/2017 | Bickmann, III et al. | |
| 2017/0335842 | A1* | 11/2017 | Robinson | F04B 53/004 |
| 2017/0370524 | A1* | 12/2017 | Wagner | F16N 13/02 |
| 2018/0363434 | A1 | 12/2018 | Coli et al. | |
| 2018/0363435 | A1 | 12/2018 | Coli et al. | |
| 2018/0363436 | A1 | 12/2018 | Coli et al. | |
| 2018/0363437 | A1 | 12/2018 | Coli et al. | |
| 2018/0363438 | A1 | 12/2018 | Coli et al. | |
| 2019/0055827 | A1 | 2/2019 | Coli et al. | |
| 2019/0112908 | A1 | 4/2019 | Coli et al. | |
| 2019/0169971 | A1 | 6/2019 | Dehring et al. | |
| 2019/0211661 | A1 | 7/2019 | Reckels et al. | |
| 2020/0309113 | A1* | 10/2020 | Hunter | F04B 49/06 |

FOREIGN PATENT DOCUMENTS

| | | | | |
|---|---|---|---|---|
| AR | 104824 | A2 | 8/2017 | |
| AR | 104825 | A2 | 8/2017 | |
| AR | 104826 | A2 | 8/2017 | |
| AR | 087298 | A1 | 12/2017 | |
| CA | 2773843 | A | 10/2012 | |
| CA | 2835904 | A1 | 10/2012 | |
| CA | 2845347 | A1 | 10/2012 | |
| CA | 2900387 | A1 | 10/2012 | |
| CA | 2955706 | A1 | 10/2012 | |
| CA | 3061972 | A1 | 11/2018 | |
| CN | 201953368 | U | 8/2011 | |
| CN | 102602322 | B | 4/2014 | |
| CN | 207194878 | U | 4/2018 | |
| CN | 105937557 | B | 7/2018 | |
| EP | 3025019 | B1 | 2/2018 | |
| EP | 3444430 | A1 | 2/2019 | |
| EP | 3444431 | A1 | 2/2019 | |
| EP | 3444432 | A1 | 2/2019 | |
| EP | 3447239 | A1 | 2/2019 | |
| EP | 3453827 | A2 | 3/2019 | |
| EP | 3456915 | A1 | 3/2019 | |
| FR | 2266810 | A1 * | 10/1975 | F04B 19/02 |
| MX | 358054 | B | 8/2018 | |
| MX | 362628 | B | 1/2019 | |
| MX | 365888 | B | 6/2019 | |
| MX | 365889 | B | 6/2019 | |
| MX | 366049 | B | 6/2019 | |
| RU | 2315190 | C1 | 1/2008 | |
| WO | 2012137068 | A2 | 10/2012 | |
| WO | 2014053056 | A1 | 4/2014 | |
| WO | WO 2015/153432 | A1 | 10/2015 | |
| WO | 2018044307 | A1 | 3/2018 | |
| WO | 2018075034 | A1 | 4/2018 | |
| WO | WO 2018/101912 | A1 | 6/2018 | |
| WO | WO 2018/209248 | A1 | 11/2018 | |

OTHER PUBLICATIONS

FMC Technologies, "Operation and Maintenance Manual, Pump Assembly Operating Manual, Well Service Pump," Doc. No. OMM50003255, May 26, 2015, 98 pages.

Int'l Search Report received in copending PCT Application No. PCT/US2019/043982 dated Oct. 9, 2019, 8 pages.

204US00 English translation of Office Action issued in the prosecution of application AR087298 B1 dated Dec. 29, 2017, 5 pages.

MX362628 Espacenet English Abstract, Publication Date of Jan. 29, 2019, 1 page.

MX365888 Espacenet English abstract, Publication date of Jun. 19, 2019, 1 page.

MX365889 Espacenet English Abstract, Publication Date of Jun. 19, 2019, 1 page.

MX366049B Espacenet English Abstract, Publication Date of Jun. 26, 2019, 1 page.

Gardner Denver Inc., "Well Servicing Pump, Model GD-25000, GD0-25000-HD, Quintuplex Pumps, GWS Fluid End Parts List", 302FWF997 Rev H, Jul. 2008, 39 pages, Tulsa, OK.

Gardner Denver, "C-2500 Quintuplex Well Service Pump", www.gardenerdenver.com, Dec. 7, 2018, 2 pages.

Gardner Denver, Inc., "GD-2500 Quintuplex Well Service Pump", 2003, 2 pages, USA.

Gardner Denver, Inc., "Well Servicing Pump, Model GD-25000 Quintuplex, Power End Parts List", 300FWF997 Rev G, Apr. 2007, 15 pages, Tulsa, OK.

Gardner Denver, Inc., Well Servicing Pump, Model GD-25000 Quintuplex, Operating and Service Manual, 300FWF996 Revision F, Apr. 2011, 50 pages, Tulsa, OK.

Canadian Patent Office, First Office Action, Canadian Patent Application No. 3,106,032, dated Mar. 31, 2022, five pages.

European Patent Office, Extended European Search Report, European Patent Application No. 19848136.8, dated Jul. 29, 2019, 14 pages.

Canadian Intellectual Property Office, Examination Report, Canadian Patent Application No. 3,124,655, dated Sep. 28, 2022, six pages.

(56) References Cited

OTHER PUBLICATIONS

European Patent Office, Extended European Search Report, European Patent Application No. 19903637.7, dated Oct. 11, 2022, 15 pages.

* cited by examiner

ENGAGEMENT AND DISENGAGEMENT WITH EXTERNAL GEAR BOX STYLE PUMPS

CROSS-REFERENCE TO RELATED APPLICATIONS

This application claims the benefit of U.S. Prov. Appl. Nos. 62/715,165 filed 6 Aug. 2018 and 62/786,174 filed 28 Dec. 2018, which are both incorporated herein by reference in their entireties.

BACKGROUND

Hydraulic fracturing has been commonly used by the oil and gas industry to stimulate production of hydrocarbon producing wells, such as oil and/or gas wells. Hydraulic fracturing, sometimes called "fracing" or "fracking" is the process of injecting fracturing fluid into a wellbore to fracture the subsurface geological formations and release hydrocarbons. The fracturing fluid is pumped into a wellbore at a pressure sufficient to cause fissures within the underground geological formations. Once inside the wellbore, the fracturing fluid fractures the underground formation. The fracturing fluid may include water, various chemical additives, and proppants that promote the extraction of the hydrocarbon reserves, such as oil and/or gas. Proppants, such as fracturing sand, prevent fissures and fractures in the underground formation from closing; thereby, allowing the formation to remain open so that hydrocarbons flow through the hydrocarbon wells.

Implementing fracturing operations at well sites requires extensive investment in equipment, labor, and fuel. A typical fracturing operation uses fracturing equipment, personnel to operate and maintain the fracturing equipment, large amounts of fuel to power the fracturing operations, and relatively large volumes of fracturing fluids. As such, planning for fracturing operations is complex and encompasses a variety of logistical challenges that include minimizing the on-site area or "footprint" of the fracturing operations, providing adequate power and/or fuel to continuously power the fracturing operations, increasing the efficiency of the hydraulic fracturing equipment, and reducing the environmental impact resulting from fracturing operations. Thus, numerous innovations and improvements of existing fracturing technology are needed to address the variety of complex and logistical challenges faced in today's fracturing operations.

SUMMARY

The following presents a simplified summary of the disclosed subject matter to provide a basic understanding of some aspects of the subject matter disclosed herein. This summary is not an exhaustive overview of the technology disclosed herein, and it is not intended to identify key or critical elements of the invention or to delineate the scope of the invention. Its sole purpose is to present concepts in a simplified form as a prelude to the more detailed description that is discussed later.

In one embodiment, a fracturing transport comprising: an external gear box for a pump, wherein the external gear box comprises a gear box dual shaft with a first end and a second end; a prime mover that includes a motor shaft, wherein one end of the motor shaft couples to the first end of the gear box shaft; an engagement coupling affixed to the second end of the gear box shaft; and an engagement panel that selectively engages or disengages the engagement coupling to the external gear box.

In another embodiment, a pump comprising: a fluid end assembly; a power end assembly that couples to the fluid end assembly; and an external gear box that couples to the power end assembly, wherein the external gear box comprises a gear box dual shaft with a first end and a second end, wherein the first end axially extends in a direction opposite to a second end.

In yet another embodiment, a method for selectively engaging and disengaging a pump from a motor. The method comprises engaging an engagement coupling attached to one end of a gear box dual shaft to a gear box connector of an external gear box, wherein the external gear box is part of a pump; rotating the gear box dual shaft to drive the pump after engaging the engagement coupling with the gear box connector; disengaging the engagement coupling from the gear box connector; and rotating the gear box dual shaft without driving the pump after disengaging the engagement coupling with the gear box connector.

In yet another embodiment, each of the above described embodiments and variations thereof, may be implemented as a method, apparatus, and/or system.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

Figure 1:
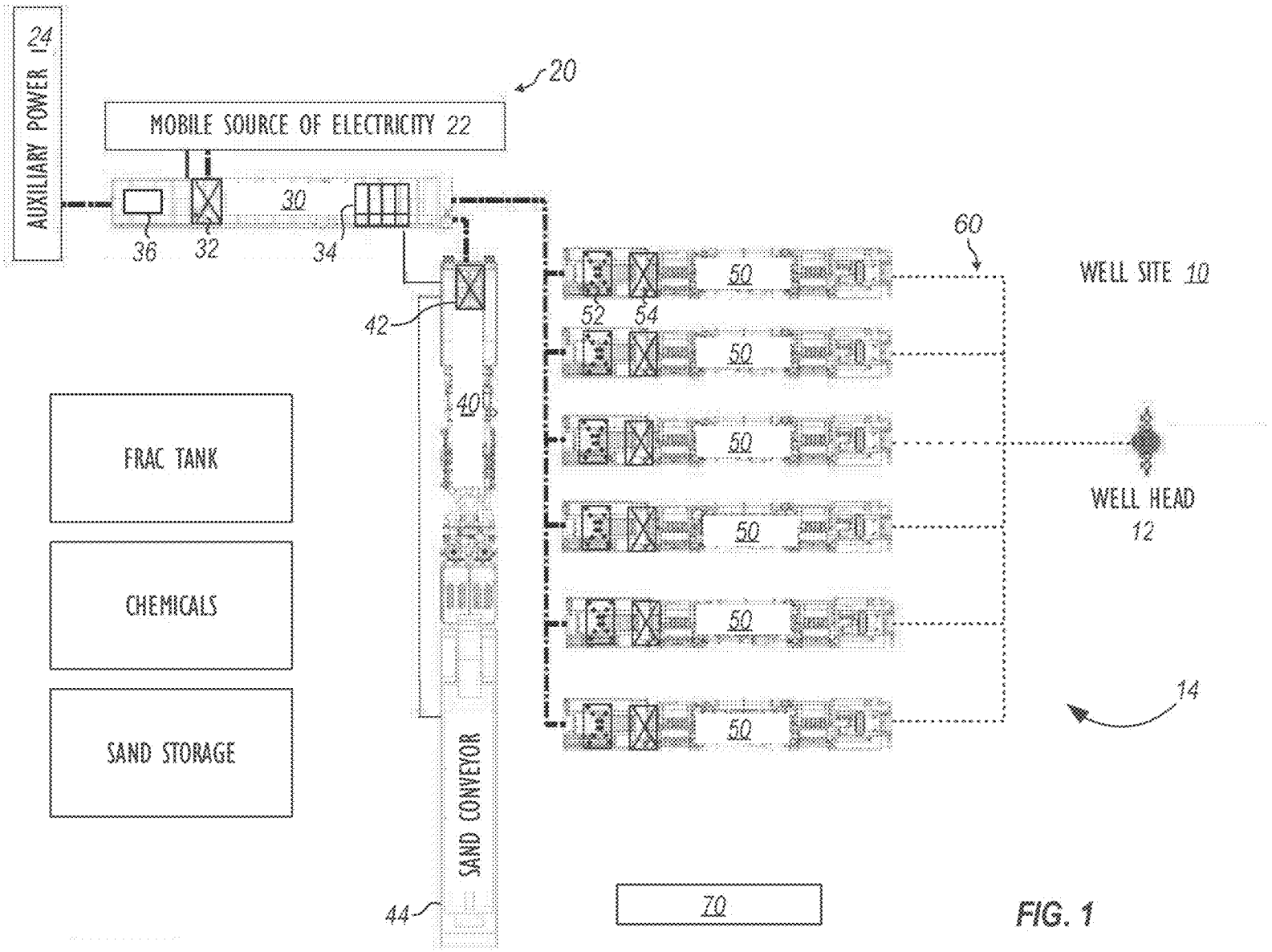
FIG. 1 is a schematic diagram of an embodiment of a medium voltage power distribution system for a fracturing fleet located at well site.

While certain embodiments will be described in connection with the illustrative embodiments shown herein, the invention is not limited to those embodiments. On the contrary, all alternatives, modifications, and equivalents are included within the spirit and scope of the invention as defined by the claims. In the drawing figures, which are not to scale, the same reference numerals are used throughout the description and in the drawing figures for components and elements having the same structure, and primed reference numerals are used for components and elements having a similar function and construction to those components and elements having the same unprimed reference numerals.

SUMMARY OF THE DISCLOSURE

According to the present disclosure, a fracturing transport comprises: a prime mover, a first pump, a first gear box, a first gear shaft, and a first coupling. The prime mover has a motor shaft and is operable to transmit drive to the motor shaft. The first pump is disposed adjacent the prime mover, and the first gear box (connected to the first pump) and the first gear shaft (disposed on the first gear box) are used to transmit the drive from the prime mover to the pump.

To do this, the first gear shaft is connected to the transmitted drive of the motor shaft. In general, the first coupling is disposed between the motor shaft and the gear shaft and is selectively coupleable between a coupled condition and an uncoupled condition. The first coupling in the coupled condition transfers the transmitted drive to the first gear box, while the first coupling in the uncoupled condition isolates the transmitted drive from the first gear box.

In one embodiment, the first coupling is disposed with the motor shaft and can be a plate clutch coupling. In other embodiments, the first coupling is disposed with the first gear shaft. Here, the first gear shaft may have a first end disposed toward the prime mover, and the first coupling can be a plate clutch coupling disposed with the first end. Alternatively, the first gear shaft may have first and second ends, with the first end disposed toward the prime mover and receiving the transmitted drive. The second end can extend beyond the other side the first gear box, and the first coupling can be disposed with this second end.

In these embodiments, rather than simply transfer the drive of the gear shaft to the gear box, the first coupling is selectively coupleable between a coupled condition and an uncoupled condition relative to the first gear box. The first coupling in the coupled condition transfers the transmitted drive of the first gear shaft to the first gear box, while the first coupling in the uncoupled condition isolates the transmitted drive of the first gear shaft from the first gear box.

The first gear box can be disposed externally on the first pump, as an external gear box. The first gear shaft can have first and second ends extending from opposite sides of the external first gear box. In this case, the first end can be disposed toward the prime mover and can be connected to the transmitted drive of the motor shaft, whereas the second end can have the first coupling.

Various mechanisms can be used for the first coupling, including a spline coupling, a clutch, an air clutch, an electro-magnetic clutch, a hydraulic clutch, or a plate clutch. In general, the first coupling can include a first coupling element, a second coupling element, and an actuator. The first coupling element is disposed on the first gear shaft and is rotated with the first gear shaft. The second coupling element is disposed on the first gear shaft and is rotatable relative to the first gear shaft. The second coupling element is connected by the external gear box to the first pump for transferring the transmitted drive thereto. For example, the second coupling can connect to a gear box gear in the gear box for reducing rotation from the prime mover to the pump. The actuator is engaged with the first coupling element and is actuatable to selectively couple the first coupling element between the coupled and uncoupled conditions relative to the second coupling element.

A bearing can be disposed between the actuator and the first coupling element to isolate rotation of the first coupling element from the first actuator. The first coupling element can include a spline hub being longitudinally movable along the first gear shaft relative to the second coupling element between the coupled and uncoupled conditions. For its part, the second coupling element can be a spline gear being mated with the spline hub in the coupled condition and being unmated with the spline hub in the uncoupled condition.

Various mechanisms for actuation can be used to operate the coupling between its operable conditions. For example, the actuator can include a hydraulic piston, a pneumatic piston, an electric motor, or an electric solenoid. A control system in communication with the first actuator can also be used to transmit actuation to the actuator to selectively couple the first coupling relative to the first gear box.

In general, the first pump can include: a power assembly coupled to the first gear box to receive the transferred drive; and a fluid assembly driven by the power assembly and configured to pressurize fluid. Moreover, the prime mover can include an electric motor or a hydrocarbon fuel-based motor.

The fracturing transport can include a second arrangement of pump, gear box, and coupling connected on the opposite side of the prime mover to be operated in a comparable manner. In this way, one, both, or none of the pumps can be coupled to the prime mover at a given time during operations by actuation of the respective couplings.

According to the present disclosure, a pump is powered by transmitted drive of a prime mover to pump fluid. The pump comprises: a fluid assembly configured to pressurize the fluid; and a power assembly coupled to the fluid assembly and transferring the transmitted drive to the fluid assembly. A gear box of the pump is coupled externally to the power end assembly and transfers the transmitted drive to the power end assembly. A gear shaft disposed on the gear box is coupled to the prime mover and receives the transmitted drive therefrom.

Finally, an engagement coupling is disposed with the gear shaft and is selectively coupleable between a coupled condition and an uncoupled condition relative to the gear box. The engagement coupling in the coupled condition transfers the transmitted drive of the gear shaft to the gear box, whereas the engagement coupling in the uncoupled condition isolates the transmitted drive of the gear shaft from the gear box.

Similar configurations described above can be used for the engagement coupling of the disclosed pump. For example, the engagement coupling can include an actuator engaged with the engagement coupling and configured to selectively couple the engagement coupling between the coupled and uncoupled conditions relative to the gear box. Additionally, the engagement coupling can include: a spline hub rotatable relative to the gear shaft and coupled to the gear box; and a spline coupling rotating with the gear shaft and selectively mating with the spline gear.

The gear shaft can have a first end disposed toward the prime mover, and the engagement coupling can be disposed with the first end of the gear shaft. Alternatively, the gear shaft can have first and second ends extending from opposite sides of the gear box. The first end is disposed toward the prime mover and is connected to the transmitted drive of the motor shaft. However, the second end can have the engagement coupling.

A method is also disclosed herein for pumping fracture fluid with a pump. The pump has a fluid end assembly powered by a power end assembly driven by a prime mover. The method comprises: rotating a gear box shaft of a gear box coupled to the power end assembly by receiving drive from the prime mover at a first end of the gear box shaft; and selectively transferring the received drive from the gear box shaft to the gear box. To selectively transfer the drive, the method comprises: engaging an engagement coupling, disposed on a second end of the gear box shaft, with the gear box and transmitting the rotation of the gear box shaft to the gear box, and disengaging the engagement coupling from the gear box and rotating the gear box shaft without transmission of the rotation to the gear box. Engaging and disengaging the engagement coupling from the gear box connector can include utilizing hydraulic power to move the engagement coupling.

The foregoing summary is not intended to summarize each potential embodiment or every aspect of the present disclosure.

DETAILED DESCRIPTION

FIG. 1 is a schematic diagram of a fracturing fleet 14 located at a well site 10 having one or more wellheads 12. In this example, the fracturing fleet 14 includes one or more power sources 20, a switch gear transport 30, a blender-hydration transport 40, and one or more fracturing pump transports 50. As will be appreciated, other arrangements are possible.

The switch gear transport 30 has one or more transformers 32 and one or more circuit breakers 34 in electrical communication with the one or more power sources 20 of electricity, such as a mobile source 22 and an auxiliary source 24. In turn, the switch gear transport 30 is in electrical communication with one or more power consumers, such as a hydration-blender transport 40 and one or more fracturing pump transports 50.

Briefly, the switch gear transport 30 may include a black start generator 36 that provides electric power to initiate and start at least one of the one or more power sources 20 of electricity. For example, the power source 20 of electricity can include one or more turbine-electric generator transports 22 that compress and mix combustion air with hydrocarbon fuel to spin and generate mechanical energy and then converts the mechanical energy to electricity. The power source 20 of electricity can also include an inlet and exhaust transport that provides ventilation and combustion air to the turbine-electric generator transport when generating electricity. Configuring and utilizing a turbine-electric generator transport and an inlet and exhaust transport are discussed and shown in more detail in U.S. Pat. No. 9,534,473, filed Dec. 16, 2015 by Jeffrey G. Morris et al. and entitled "Mobile Electric Power Generation for Hydration Fracturing of Subsurface Geological Formations," which is hereby incorporated by reference as if reproduced in its entirety. In other embodiments, the power source 20 of electricity could include other transport configurations to employ a centralized source of electricity that powers fracturing equipment.

Once the at least one power source 20 of electricity is operational, the switch gear transport 30 receives electric power from the power sources 20 of electricity at a designated input voltage level and outputs the electric power to the power consumers or transports 40, 50. When the transports 40, 50 receive the electric power at the target output voltage level, each of the transports 40, 50 can include one or more transformers 42, 52, and 54 that step down the target output voltage level (e.g., 13.8 kV) to one or more lower voltage levels that equipment (e.g., electric prime movers) mounted on the transports 40, 50 may utilize.

For example, the hydration-blender transport 40 receive the electric power to power a plurality of electric blenders. A plurality of prime movers may drive one or more pumps that pump source fluid and blender additives (e.g., sand) from a sand conveyor 44 into a blending tub, mix the source fluid and blender additives together to form fracturing fluid, and discharge the fracturing fluid to the fracturing pump transports 50. In one embodiment, the electric blender may be a dual configuration blender that comprises electric motors for the rotating machinery that are located on a single transport.

For its part, the fracturing pump transport 50 receives the electric power to power a prime mover (not shown). The prime mover converts electric power to mechanical power for driving one or more pumps (not shown). The pumps on the fracturing pump transports 50 pump the fracturing fluid to a hydraulic fracturing manifold at the wellhead 12. The pressurized fracturing fluid can be delivered using piping and manifolds to the wellhead 12 in any suitable arrangement known in the art.

In one embodiment, the prime mover on the fracturing pump transport 50 may be a dual shaft electric motor that drives two different pumps. The fracturing pump transport 50 may be arranged such that one pump is coupled to opposite ends of the dual shaft electric motor and avoids coupling the pumps in series. By avoiding coupling the pump in series, the fracturing pump transport 50 may continue to operate when either one of the pumps fails or have been removed from the fracturing pump transport 50 for repair or replacement. Additionally, repairs to the pumps may be performed without disconnecting the system manifolds that connect the fracturing pump transport 50 to other fracturing equipment within the mobile fracturing system 14 and wellhead 12.

A data van 70 may be part of a control network system, where the data van 70 acts as a control center configured to monitor and provide operating instructions in order remotely operate the mobile source of electricity 22, the blender transport 40, the fracturing pump transport 50, and/or other fracturing equipment within the mobile fracturing system 14. For example, the data van 70 may communicate via the control network system with the VFDs located within the transports (e.g., 50) that operate and monitor the health of the electric motors used to drive the pumps on the fracturing pump transports 50. In one embodiment, the data van 70 may communicate with the variety of fracturing equipment using a control network system that has a ring topology. A ring topology may reduce the amount of control cabling used for fracturing operations and increase the capacity and speed of data transfers and communication.

Other fracturing equipment, such as gas conditioning transport, water tanks, chemical storage of chemical additives, hydration unit, sand conveyor, and sandbox storage, may not be shown in FIG. 1, but would be known by persons of ordinary skill in the art. Therefore, the other equipment is not discussed in further detail.

Moreover, although FIG. 1 illustrates an example of fracturing fleet 14 that utilizes electric power for operations, the disclosure is not limited to this particular example. For instance, the fracturing pump transports 50 of the present disclosure may not be powered by electric power and may instead use a prime mover powered by a combustion engine or the like to operate the pumps on the transports 50. Further still, the switch gear transport 30 can receive electric power from other types of power sources, such as a power grid or a stationary power source. The fracturing fleet 14 may utilize a separate hydration transport and blender transport instead of a combined hydration-blender transport 40.

Figure 2:
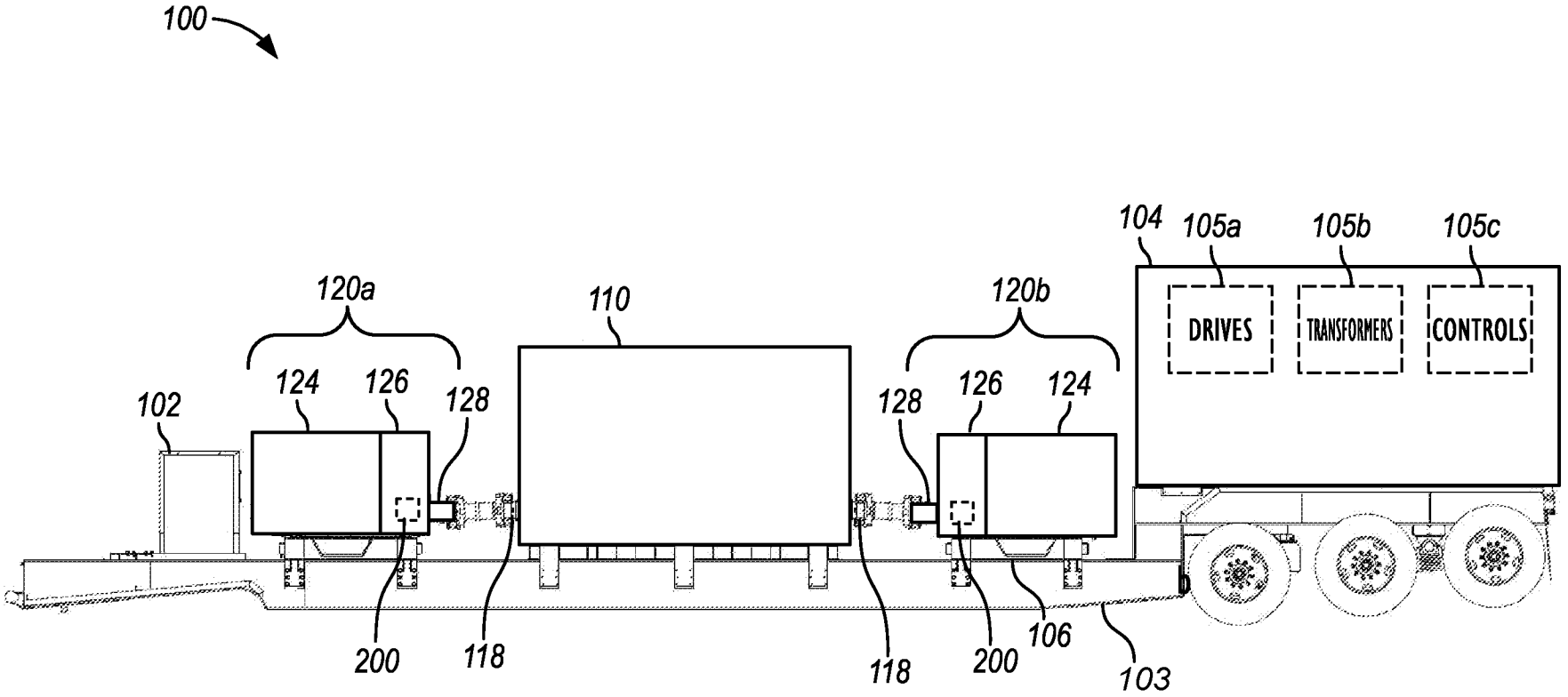
FIG. 2 is a schematic diagram of an embodiment of a fracturing pump transport that can engage and disengage one or more pumps from a prime mover.

Turning now to details of how a prime mover connects to pumps, FIG. 2 is a schematic diagram of an embodiment of a fracturing pump transport 100. According to the present disclosure, various example embodiments are disclosed herein for the fracturing pump transport 100 that can engage and disengage a prime mover 110 from an external gear box style pump 120*a-b* on the transport 100. In one embodiment, the external gear box style pump 120*a-b* is a well services pump that generates high-pressure fracturing fluid. For example, the external gear box style pump 120*a-b* may be a plunger style pump that operates within a desired mechanical power range, such as about 1,500 horsepower (HP) to about 5,000 HP, to discharge fracturing fluid at relatively high pressures (e.g., about 10,000 pounds per square inch (PSI)).

As discussed in more detail below, the external gear box style pump 120*a-b* includes an external gear box 126 mounted on or attached to the pump 120*a-b*. The external gear box 120 houses one or more gears for transferring (e.g., reducing) the rotation from of the prime mover 110 to the associated pump 120*a-b*. For example, the external gear box 126 connects to a power end assembly 124 of the pump 120*a-b*, which has one or more pinion gears that engage one or more bull gears. In turn, the power end assembly 124 generates torque to drive a fluid end assembly (e.g., plungers) of the external gear box style pump 120*a-b* to pressurize the fracturing fluid for a hydraulic fracture operation.

The external gear box 126 also includes a gear box dual shaft 128 that protrudes on opposite sides of the external gear box 126. One end of the gear box dual shaft 128 connects to a drive shaft driven by a motor shaft 118 of the prime mover 110. The other end of the gear box dual shaft 128 connects to a coupling 200 that can engage and disengage the pump 120*a-b* from the prime mover 110. For example and as discussed below, one element (e.g., spline coupling) of the coupling 200 can be moved back and forth on the gear box dual shaft 128 to engage or disengage another element (e.g., a spline hub) of the coupling 200. The spline hub is connected to or part of an internal gear in the external gear box 126 that generates torque to rotate the pinion gears and/or bull gears of the pump 120*a-b*.

Specifically, FIG. 2 illustrates an elevational view of the fracturing pump transport 100, which includes an engagement panel 102 that adjusts the engagement couplings 200 to engage and disengage either one or both of the pumps 120*a-b* from prime mover 110. As an example, the engagement panel 102 includes levers or switches that an operator manually operates to engage or disengage the gear box shafts 128*a-b* to the pumps 120*a-b*, respectively. Additionally or alternatively, to engage and disengage the pumps 120*a-b* from the gear box shafts 128*a-b*, the engagement panel 102 may include electronic controllers that generate controls and/or receive instructions from remote locations, such as a monitoring station that is part of a power and control system 104, another location at the well site (e.g., data van), and/or off-site. For example, if both pumps 120*a-b* are initially in an engaged position, in response to receiving a remote command or to generating a local control, the engagement panel 102 may trigger the disengagement of a first pump 120*a* while a second pump 120*b* remains in the engaged position. As will be appreciated with the benefit of the present disclosure, disengagement may be performed for any number of reasons during operations.

FIG. 2 also illustrates that the fracturing pump transport 100 utilizes a lay-down trailer 103 to enhance mobility, improved safety, and enhance ergonomics for crew members when performing routine maintenance and operations of the pumps 120*a-b*. The lay-down trailer 103 positions the pumps 120*a-b* lower to the ground as the main trailer beams are resting on the ground in operational mode. With the lay-down trailer design, the fracturing pump transport 100 has an upper section above the trailer axles that may hold or have mounted the power and control systems 104.

The power and control system 104 may include one or more electric drives 105*a* (e.g., variable frequency drives (VFD)), transformers 105*b*, controls 105*c* (e.g., a programmable logic controller (PLC) located on the fracturing pump transport 100), and cable connections (not shown) to other transports (e.g., switch gear transport). The electric drives 105*a* may provide control, monitoring, and reliability functionality, such as preventing damage to a grounded or shorted prime mover 110 and/or preventing overheating of components (e.g., semiconductor chips) within the electric drives. The transformers 105*b* within the power and control systems 104 can step one or more input voltages (e.g., 13.8 kilovolts (kV)) to one or more lower voltages (e.g., 4.2 kV, 2.1 kV, 600 and 480 volts (V)).

In one embodiment, the prime mover 110 may be a dual shaft electric motor that has a motor shaft 118 that protrudes on opposite sides of the electric motor. The dual shaft electric motor 110 may be any desired type of alternating current (AC) or direct current (DC) motor. For example, the dual shaft electric motor 110 may be an induction motor, and in another example the dual shaft electric motor 110 may be a permanent magnet motor.

Other embodiments of the prime mover 110 may include other electric motors that are configured to provide about 5,000 HP or more. For example, the dual shaft electric motor 110 may deliver motor power in a range from about 1,500 HP to about 10,000 HP. Specific to some embodiments, the dual shaft electric motor 110 may be about a 5,000 HP rated electric motor, about a 7,000 HP rate electric motor, or about a 10,000 HP electric motor. The prime mover 110 may be driven by at least one variable frequency drive 105*a* that is rated to a maximum of about 5,000 HP and may receive electric power generated from the mobile source of electric power.

The fracturing pump transport 100 may reduce the footprint of fracturing equipment on a well-site by placing the two pumps 120*a-b* on the same transport 100. Moreover, larger pumps 120*a-b* may be coupled to the prime mover 110 that operate with greater horsepower to produce additional equipment footprint reductions. In one embodiment, each of the pumps 120*a-b* may be a quintiplex pump located on the same transport 100. Other embodiments may include other types of plunger style pumps 120*a-b*, such as triplex pumps. The pumps 120*a-b* may each operate from a range of about 1,500 HP to about 5,000 HP. Specifically, in one or more embodiments, each of the pumps 114*a-b* may operate at HP ratings of about 1,500 HP, 1,750 HP, 2,000 HP, 2,250 HP, 2,500 HP, 2,600 HP, 2,700 HP, 3,000 HP, 3,500 HP, 4,000 HP, 4,500 HP, and/or 5,000 HP.

The prime mover 110 and each of the pumps 120*a-b* may be mounted on sub-assemblies 106 for isolating and allowing for individual removal from the fracturing pump transport 100. In other words, the prime mover 110 and each of the pumps 120*a-b* can be removed from service and replaced without shutting down or compromising other portions of the fracturing system. If the prime mover 110 needs to be replaced or removed for repair, the prime mover sub-assembly 106 may be detached from the fracturing pump transport 100 without removing the two pumps 120*a-b* from the fracturing pump transport 100. For example, the first pump 120*a* can be isolated from the fracturing pump transport 100, removed and replaced by a new pump 120*a*. If the prime mover 110 and/or the pumps 120*a-b* require service, an operator can isolate the different components from the fluid lines, and unplug, un-pin, and remove the prime mover 110 and/or the pumps 120*a-b* from the fracturing pump transport. Furthermore, each pump sub-assembly 106 may be detached and removed from the fracturing pump transport 100 without removal of the other pump 120*a-b* and/or the prime mover 110.

In the arrangement of FIG. 2, the pumps 120*a-b* are well service pumps (e.g., plunger-style pumps) that each include an external gear box 126 that houses one or more gears. The external gear boxes 126 are in a separate and/or distinct enclosure than the power end assemblies 124. In prior well service pumps, such as plunger-style pumps, transfer gears to step rotation/torque from the motor 110 to the pinion gears and bull gears would be part of (or embedded within) the power end assemblies 124. In other words, prior well service pumps would house gear box gears within the power end assemblies 124. However, to improve pump performance and/or efficiency, the gear box gears are separated out from the power end assemblies 124 and moved to the external gear boxes 126. The additional space potentially occupied by the external gear boxes 126 can reduce the available distance between the prime mover 110 and pumps 120*a-b*, especially when a reduced footprint for the transport 100 is desired along with the increased horsepower sought for the transport 100. In the end, the external gear boxes 126 may cause space issues that prevent and/or complicate the utilization of certain connections to engage the pumps 120*a-b* with (and disengage from) the prime mover 110.

To engage and disengage within a limited space, an engagement coupling 200 of the present disclosure is incorporated into the external gear box 126 on the pumps 120*a-b*. In one embodiment and as discussed in more detail below, the engagement coupling 200 may be a spline coupling that engages and disengages with a spline hub affixed to the external gear box 126 by mating and unmating matching splines, teeth, slots, and the like. The spline hub can be connected to or be part of a gear box gear within the external gear box 126 that generates torque to rotate the pinion gears and/or bull gears. The spline coupling is attached to one end of a gear box dual shaft 128, and the other end of the gear box dual shaft 128 connects to a drive shaft driven by the motor shaft 118 of the prime mover 110. To engage the pumps 120*a-b* with (or disengage from) the torque (e.g., rotation, drive, etc.) of the prime mover 110, the spline coupling may move back and forth to engage or disengage the spline hub.

Other embodiments of the engagement couplings 200 to engage and disengage the drive between the prime mover 110 and the pumps 120*a-b* can include air clutches, electromagnetic clutches, hydraulic clutches, plate clutches, and/or other clutches and disconnects. The engagement couplings 200 can have manual and/or remote operated disconnect devices. Engaging and disengaging the drive between the pumps 120*a-b* and the prime mover 110 with the spline hub and spline coupling is discussed in more detail below.

In one or more embodiments, the engagement panel 102 and/or the power and control system 104 are loaded with software such that remote equipment (e.g., data van 70; FIG. 1) can interface and provide instructions to implement pump indexing operations. Indexing of the pumps 120*a-b* prevents the two pumps 120*a-b* from fighting each other's resonance during pumping operations. The pump indexing operation can utilize the fracturing pump transport's 100 ability to remotely engage and disengage the pumps 120*a-b* to remotely perform the pump indexing operations. Being able to remotely perform pump indexing operations prevents operators from sending personnel into hazardous working conditions or interrupting fracturing operations. For example, manually performing pump indexing operations while other fracturing pump transports 100 are pressurized and operational. Alternatively, to reduce risks, an operator may cease fracturing operations for all fracturing equipment to allow personnel to manually perform pump indexing operations.

As an example, the engagement panel 102 and/or the power and control system 104 can initially receive instructions to engage a first of the pumps 120*a* to prime mover 110 and disengage a second of the pumps 120*b* from the prime mover 110. After engaging the first pump 120*a* to the prime mover 110, the motor shaft 118 is rotated until the first pump's 120*a* top dead center indicator indicates that the first pump 120*a* is clocked at a reference point of zero degrees. For example, when the first pump 120*a* is set to the top dead center, which can also be referred to being clocked at a reference point of zero degrees, the position of the first plunger and/or piston within the first pump 120*a* is at the farthest position from pump's 120*a* crankshaft. In other words, when the first pump 120*a* aligns with the top dead center indicator, the number one plunger and/or piston of the first pump 120*a* is at its highest point on a compression stroke.

Afterwards, the engagement panel 102 and/or the power and control system 104 receives instructions to disengage the first pump 120*a* from the prime mover 110 and to engage the second pump 120*b* to the prime mover 110. When the second pump 120*b* is engaged to the prime mover 110, the motor shaft 118 is rotated until the second pump's 120*b* top dead center indicator indicates that the second pump 120*b* is clocked at a reference point of zero degrees. Once the second pump 120*b* is clocked at the reference point zero degrees, the motor shaft is rotated 180 degrees out of phase to put the second pump 120*b* at 180 degrees from the reference point zero degrees, which can also be referred to as bottom dead center. When the second pump 120*b* is at 180 degrees from reference point zero degrees, the number one plunger and/or piston of the second pump 120*b* is at its lowest point on a compression stroke, which is the nearest position from second pump's 120*b* crankshaft. Subsequently, the first and second pumps 120*a-b* are set to both engage the motor shaft 118 of the prime mover 110. At this point, the two pumps 120*a-b* are now referenced 180 degrees out of phase from one another and are ready to pump fracturing fluid.

Although FIG. 2 illustrates a specific embodiment of a fracturing pump transport 100 that can engage and disengage one or more pumps 120*a-b* from a prime mover 110, the disclosure is not limited to this particular embodiment. For example, even though FIG. 2 illustrates that the prime mover 110 is a dual shaft prime mover, other embodiments of the fracturing pump transport 100 may use other types of prime movers that have a shaft with a single end that extends outside of the prime mover. Additionally, the prime mover 110 may not be an electric motor, and instead the prime mover 110 can be a hydrocarbon fuel-based motor (e.g., diesel engine) that drives the pumps 120*a-b*. As will be appreciated, FIG. 2 does not depict other components (e.g., plumbing, manifolds, and power connections) that persons of ordinary skill in the art may utilize to produce a fracturing pump transport 100. The use and discussion of FIG. 2 is only an example to facilitate ease of description and explanation.

Figure 3A:
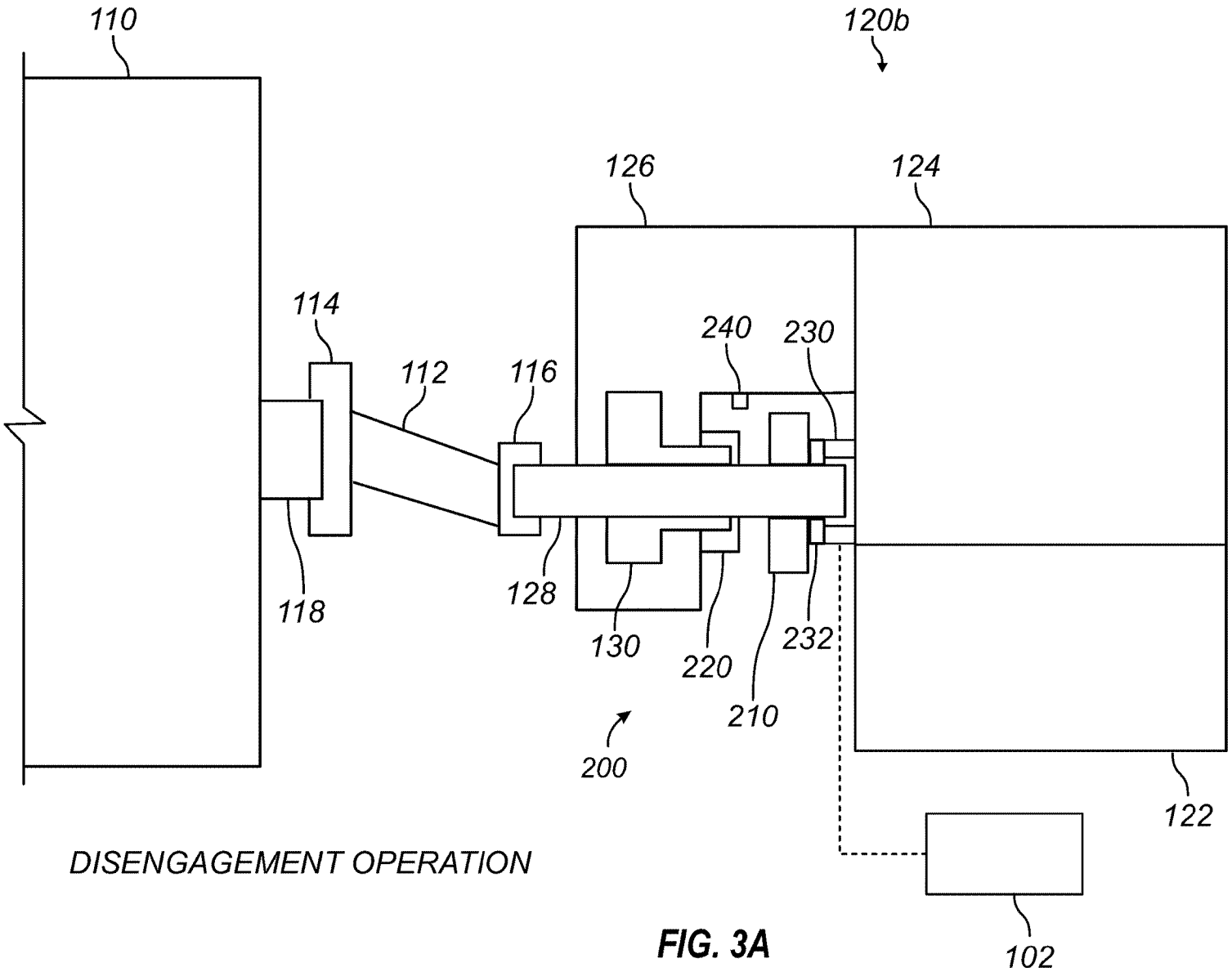
FIGS. 3A-3B illustrates top-down views of a portion of the fracturing pump transport in FIG. 2.
Figure 3B:
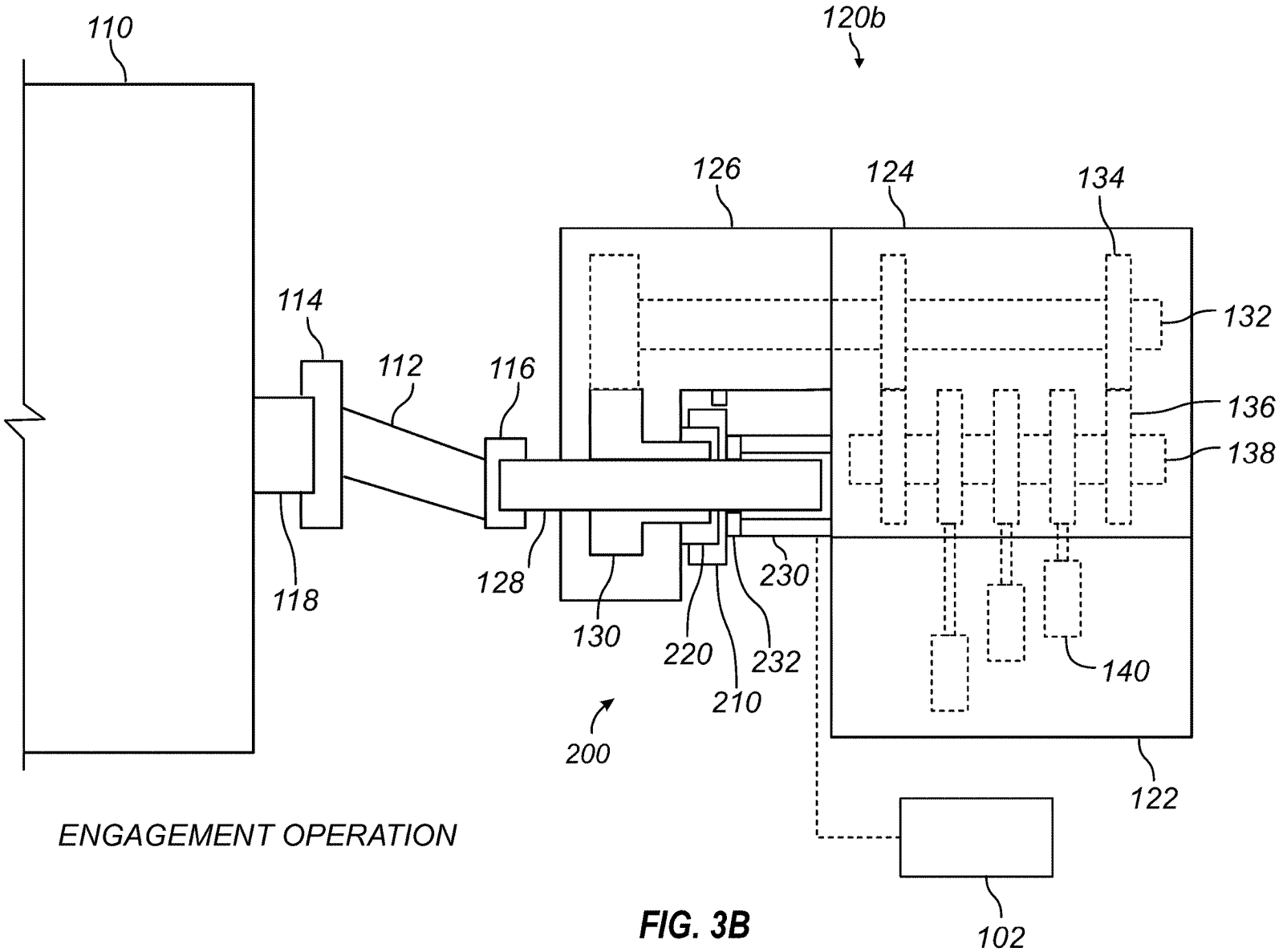

With an understanding of a fracturing pump transport 100 according to the present disclosure, discussion now turns to details of an engagement coupling 200 for use between a prime mover 110 and a pump 120. FIGS. 3A-3B illustrate top-down views of one end of the fracturing pump transport 100 of FIG. 2. As shown in FIGS. 3A-3B, one end of a motor shaft 118 on the prime mover 110 connects to a pump 120*b*, which is simply the second of the two pumps in this example. As will be appreciated, an opposite end of the motor shaft 118 on the prime mover 110 can connect to the first pump (120*a*) in a similar manner.

The end of the motor shaft 118 connects to a drive shaft 112 at a hub 114. (Within this disclosure, the drive shaft 112 can also be referred to as a torque tube.) The drive shaft 112 extends from the hub 114 to connect to a side of the external gear box 126 facing the prime mover 110. Specifically, the drive shaft 112 connects to one end of a gear box dual shaft 128 at another hub 116. Although not explicitly shown in FIG. 3A, the drive shaft 112, the motor shaft 128, and the gear box dual shaft 118 may be connected together using one or more couplings, such as a fixed coupling (e.g., flex coupling or universal joint-based coupling).

The external gear box 126 connects to the power assembly end 124 of the pump 120*b*, which connects to the fluid end assembly 122 of the pump 120*b*. To control the transfer of rotation, torque, drive, etc. from the prime mover's motor shaft 118 to the gear box 126 and further to the power assembly 124, an engagement coupling 200 (e.g., a spline coupling, clutch, or other mechanism as disclosed herein) according to the present disclosure is disposed at the other end of the gear box dual shaft 128. As shown, the end of the gear box dual shaft 128 with the engagement coupling 200 is located in a space or gap between the external gear box 126 and the power end assembly 124, which can allow for tighter spacing between the prime mover 110 and the pump 120*b* with its external gear box 126.

In FIG. 3A, the engagement coupling 200 is in a disengagement position or an uncoupled condition. By contrast, the engagement coupling 200 is in an engagement position or a coupled condition in FIG. 3B. As an example, the engagement coupling 200 can use a spline coupling 210 that engages and disengages a gear box connector 220, such as a spline hub. When in the disengagement position of FIG. 3A, the spline coupling 210 does not engage or connect to the spline hub 220.

For its part, the gear box connector 220 (e.g., spline hub) attaches to a gear 130 (e.g., spline gear) of the external gear box 126. As will be appreciated, the external gear box 126 can include various gears in spur gear designs, planetary gear designs, or the like that perform a gear reduction to drive the pinion gears and/or bull gears of the pump's power assembly 124. Even though the gear box dual shaft 128 traverses through the external gear box 126, the gear box dual shaft 128 does not internally connect to or engage the gear box gear 130 (e.g., spline gear). During a disengagement operation, rotating the drive shaft 112 causes both the gear box dual shaft 128 and the first coupling element 210 to rotate. Even though the gear box dual shaft 128 is rotating, the second coupling element 220 and the gear box gear 130 do not rotate and remain stationary.

In contrast, FIG. 3B illustrates the engagement coupling 200 is in an engagement position or a coupled condition. To engage the pump 120*b* to the prime mover 110 so the drive of the prime mover 110 is transferred to the pump 120*b*, the engagement coupling 200, which is located between the external gear box 126 and the power end assembly 124, includes an actuator 230 to engage the first coupling element 210 of the engagement coupling 200 with the second coupling element 220 (i.e., the gear box connector 220) connected to the gear box gear 130. In general, the actuator 230 can include a hydraulic piston, a pneumatic piston, an electric motor, an electric solenoid, or other actuator for moving, sliding, pushing, pulling, etc. the first coupling element 210 on the gear shaft 128 relative to the second coupling element 220.

In one embodiment, for example, hydraulic fluid and/or mechanical power is supplied by the power and control system 104 to the actuator 230. The supplied power controls the actuator 230 to adjust the engagement coupling 200 (e.g., spline coupling 210) to engage and disengage the gear box gear 130 with the rotation of the gear box dual shaft 128. As an example, a hydraulic piston or other mechanical apparatus for the actuator 230 may engage a bearing 232 that moves the first coupling element 210 of the engagement coupling 200 in a first direction toward the dual-shaft, external gear box 126 or in an opposite direction towards the power end assembly 124. In other embodiments, the actuator 230 may use electro-magnetic forces to move the first coupling element 210 on the gear box dual shaft 128.

When engaged, the second coupling element 220 transfers the rotational movement of the first coupling element 210 and gear box dual shaft 128 to the gear box gear 130. As schematically depicted in FIG. 3B, rotating the gear 130 then initiates the rotation of a pinion shaft 132 having pinion gears 134 within the external gear box 126. Recall that the pinion gears 134 within the external gear box 126 interface with one or more bull gears 136. Rotating the pinion gears 134 causes the bull gears 136 to rotate, which in turn eventual causes the rotation of a crankshaft 138 within the power assembly end 124 of pump 120*b*. To pump and pressurize fracturing fluid, the rotation of the crankshaft 138 then produces torque that moves plungers 140 in the fluid end assembly 122. Other transmission arrangements can be used in the power end assembly 124 for a given pump.

Engaging and disengaging the pumps 120*a-b* from the prime mover 110 shown in FIGS. 3A-3B can utilize other components not explicitly shown. Additionally, engagement and disengagement connection can utilize one or more proximity sensors 240 to detect when the engagement coupling 200 moves to an engagement or disengagement position (coupled or uncoupled condition), and the sensing from the sensors 240 can be relayed to the control system (104) of the transport (100) to verify activation/deactivation. Any suitable type of sensor 240 can be used, such as a proximity sensor, a contact, an encoder, etc.

As will be appreciated with the benefit of the present disclosure, connecting the external gear box 126 to the prime mover 110 may vary in the number of fixed couplings and intermediate drive shafts based on space availability, misalignment tolerances, and whether vibrations from the pumps 120*a-b* need to be deflected to avoid affecting the operation of the prime mover 110. Having fixed couplings and intermediate drive shafts 112 may allow the gear box dual shaft 128 to move or walk slightly without damaging the motor shaft 118 and/or bearings of the prime mover 110. Examples of fixed couplings may include flex couplings and/or universal joint-based coupling. The use and discussion of the arrangement in FIGS. 3A-3B are only examples to facilitate ease of description and explanation.

Figure 4A:
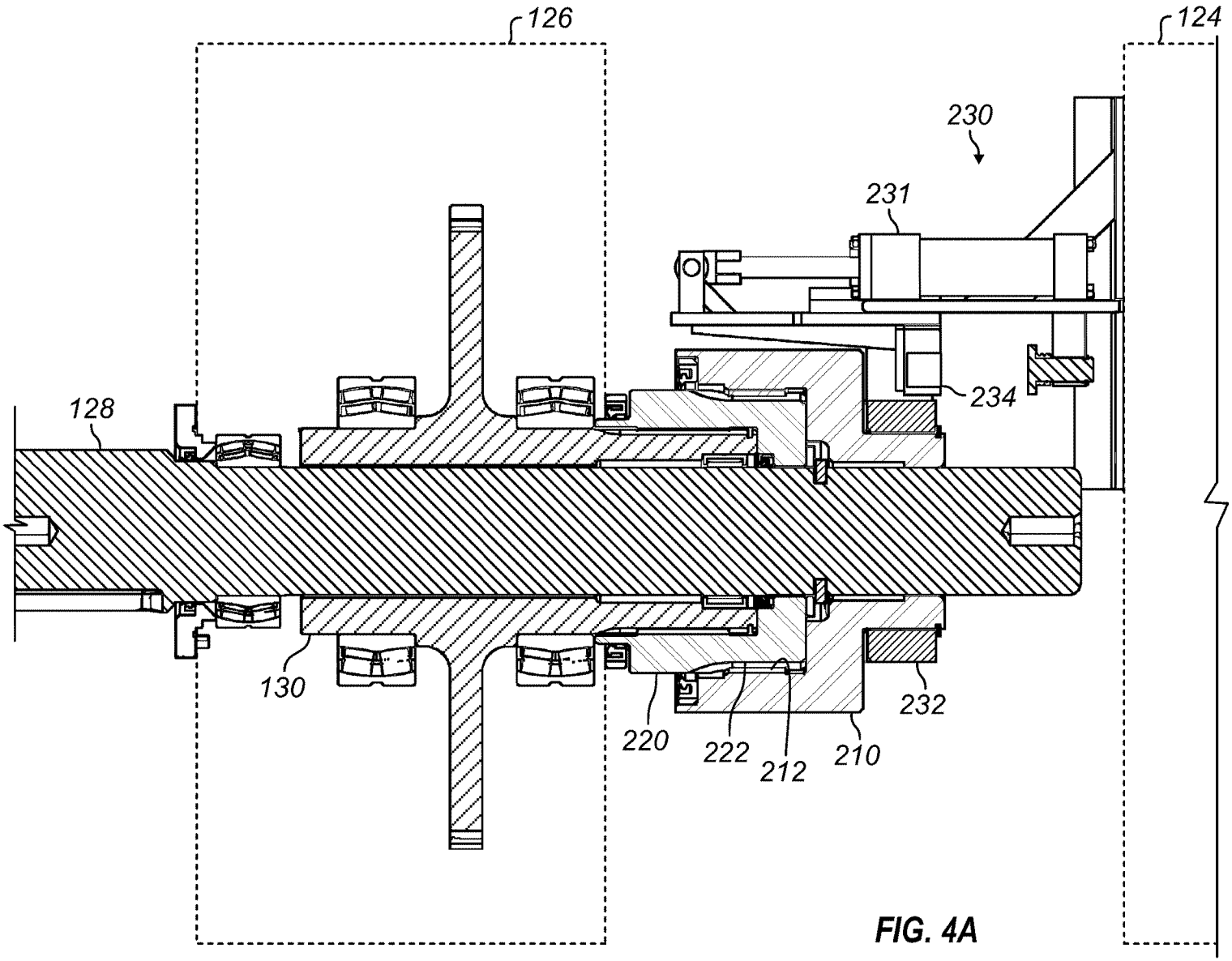
FIGS. 4A-4B illustrates cross-section views of a section of an external gear box during engagement according to the present disclosure.
Figure 4B:
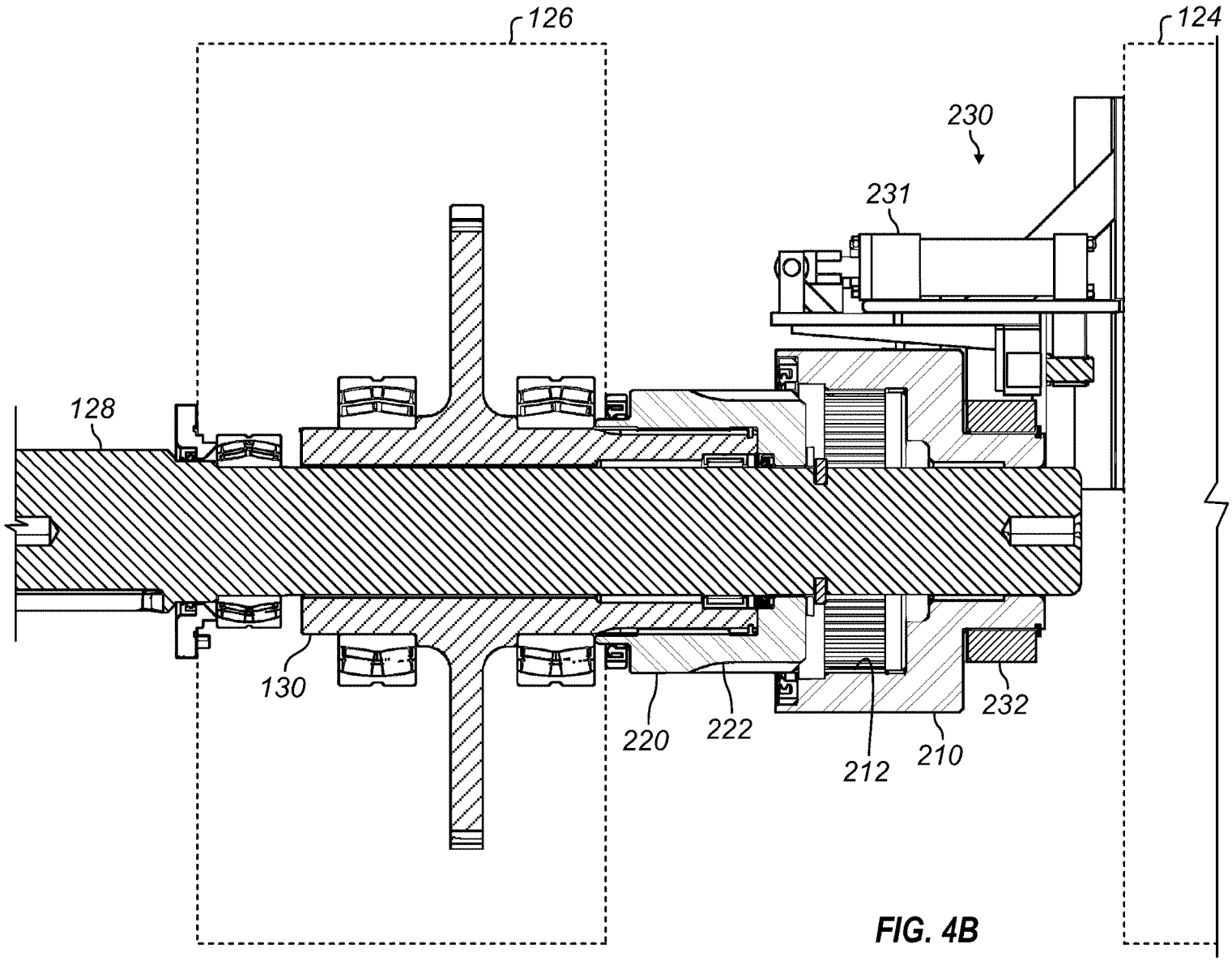

Having an understanding of an engagement coupling 200 for use between a prime mover 110 and a pump 120, discussion now turns to a particular arrangement of components of an engagement coupling 200. FIGS. 4A-4B illustrate cross-section views of a section of an external gear box 126. The engagement coupling 200 includes the first and second coupling elements 210 and 220. The first element 210 can be a spline coupling having splines 212, and the second element 220 can be a spline hub 220 having corresponding splines 222. In FIG. 4A, the spline coupling 210 engages the spline hub 220 when in an engagement position (coupled condition). By contrast, the spline coupling 210 in FIG. 4B disengages the spline hub 220 when in a disengagement position (uncoupled condition). Rather than using splines 212, 222, teeth, slots, detents or the like, strong magnetic coupling can be used for the engagement in which case either one or both of the elements 210, 220 can include magnetic elements 212, 222. Further still, the first and second coupling elements 210, 220 may be opposing clutch components that mate and unmate relative to one another. These and other possibilities disclosed herein can be used.

As discussed previously, when manual and/or remote instructions are sent to move the spline coupling 210 to engage the spline hub 220 using an actuator (not shown), the spline hub 220 translates the rotational movement from the gear box dual shaft 128 and the spline coupling 210 to the gear 130. In the disengaged position (FIG. 4B), the spline coupling 210 disengages the spline hub 220, which is attached to or part of gear 130. By disengaging, the rotational movement is not translated to the spline hub 220 and gear 130 even though the gear box dual shaft 128 and the spline coupling 210 continue to rotate. One or more rotational bearings can be used between the gear 130 and the shaft 128, which passes centrally through it.

FIGS. 4A-4B also depict that a bearing 232 can be supported by the spline coupling 210 such that bearing 232 does not move even when the spline coupling 210 rotates. In one embodiment, the bearing 232 on the spline 210 may support the coupling of one or more hydraulic piston 231 of an actuator 230 and/or proximity sensors (240) positioned adjacent to the spline coupling 210. For example, a bracket 234 that mounts to the bearing 232 may support a hydraulic piston 231 of the actuator 230 that are positioned adjacent the spline coupling 210. The hydraulic piston 231 of the actuator 230 move the spline coupling 210 a designated direction (e.g., in the direction of the prime mover 110) to engage the spline coupling 210 with the spline hub 220. When the hydraulic pistons 231 of the actuator 230 move the spline coupling 210 in an opposite direction (e.g., in the direction of the power end assembly 124), the spline-tooth coupling may disengage spline coupling 210 from the spline hub 220.

In one or more embodiments of the present disclosure to engage and disengage within a limited space, an engagement coupling 200 of the present disclosure is situated between the drive of the motor shaft 118 and the gear shaft 128. In previous embodiments, the coupling 200 is situated/disposed with the gear shaft 128, and is especially disposed with an end of the gear shaft 128 on an opposing side of the external gear box from the prime mover 110. In alternative embodiments, the coupling 200 of the present disclosed can be situated/disposed with a motor shaft end for the prime mover 110. The engagement coupling 200 can be a plate clutch coupling that engages and disengages with a drive shaft 112 that connects to a pump shaft (e.g., pinion shaft or external gear box shaft 128). The plate clutch coupling 200 can be connected to or be part of the motor shaft 118 that generates torque that rotates the drive shaft 112. To connect or disconnect the pumps 120*b* from the prime mover 110, the plate clutch coupling 200 may move back and forth to engage or disengage the drive shaft 112. The plate clutch coupling 200 may include multiple friction plates to increase the friction used to engage the end of the motor shaft 118 to the drive shaft 112. Other embodiments of the engagement couplings 200 that may be used to engage and disengage the pump prime mover 110 with the pumps 120*b* include air clutches, electro-magnetic clutches, hydraulic clutches, and/or other clutches and disconnects that have manual and/or remote operated disconnect devices.

Figure 5:
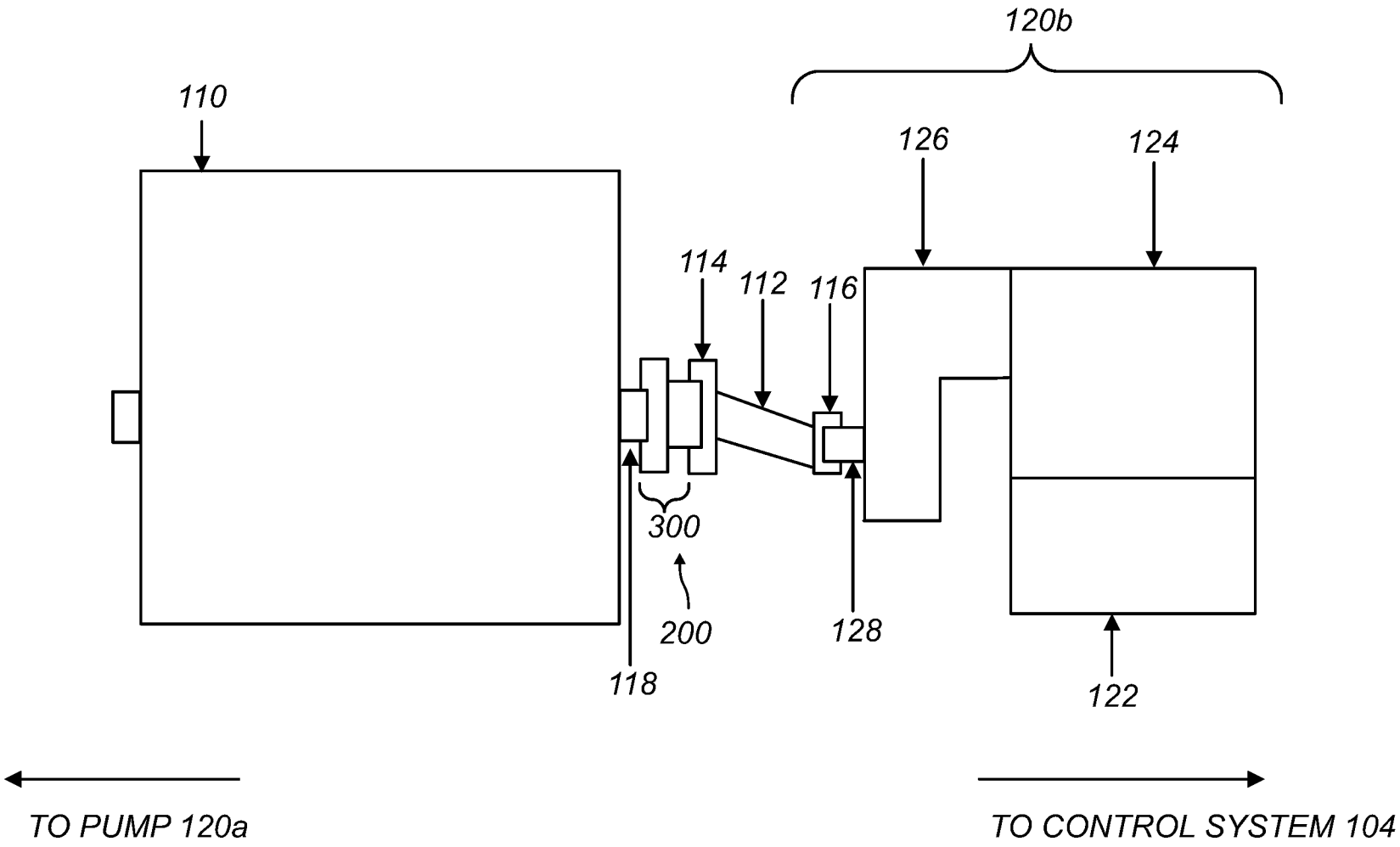
FIG. 5 is a block diagram of a plate clutch coupling attached to a motor shaft end of the pump prime mover.

In particular, FIG. 5 illustrates a top-down view of one end of the components on a fracturing pump transport. A prime mover 110 is shown with one of the pumps (e.g., 120*b*). An external gear box 126 connects to a power assembly end 124 of the pump 120*b*, which connects to the fluid end assembly 122 of the pump 120*b*.

One end of the motor shaft 118 of the prime mover 110 connects to an engagement coupling 200 according to the present disclosure. In the present example, the engagement coupling 200 is a plate clutch coupling 300. The plate clutch coupling 300 connects to a drive shaft 112 at hub 114. Within this disclosure, the drive shaft 112 can also be referred to as a torque tube. The drive shaft 112 extends from hub 114 to connect to a side of the gear box shaft 128 facing the prime mover 110. Specifically, the drive shaft 112 connects to one end of the gear box shaft 128 at hub 116. Although not explicitly shown in FIG. 5, the drive shaft 112, the motor shaft end 118, and the gear box shaft 128 may be connected using one or more couplings, such as a fixed coupling (e.g., flex coupling or universal joint-based coupling).

To engage and disengage within the limited space, the plate clutch coupling 300 engages and disengages with the drive shaft 112 that connects to the gear box shaft 128 (e.g., pump shaft). The plate clutch coupling 300 can be connected to or be part of the motor shaft end that generates torque to rotate the drive shaft 112.

To connect or disconnect pump 120*b* from the prime mover 110, the plate clutch coupling 300 may move back and forth to engage or disengage the drive shaft 112. (As will be appreciated, an actuator (not show), such as a hydraulic piston or other actuator disclosed herein, can move elements of the plate clutch coupling 300 during the activation. The plate clutch coupling 300 may include multiple friction plates (e.g., three friction plates) to increase the friction used to engage the end of the motor shaft 118 to the drive shaft 112. The plate clutch coupling 300 allows the end of the motor shaft 118 to disengage and/or engage the drive shaft 112 while the motor shaft end is rotating. In other words, the prime mover 110 does not need to be powered down and/or the motor shaft 118 does not need to stop rotating prior to engaging and/or disengaging the drive shaft 112.

Here, the plate clutch coupling 300 is affixed to (or disposed on) the end of the motor shaft 118. In another arrangement, the plate clutch coupling 300 can be affixed to (or disposed on) the end of the gear shaft 128. Operation of the plate clutch coupling 300 disposed with the gear shaft 128 can be comparable to that discussed above and may also include an actuator (not shown) as disclosed herein. Moreover, as already noted in previous embodiments, an engagement coupling 200, such as the plate clutch coupling 300 discussed here, can be disposed with an opposite end of the gear shaft 128 extending on the other side of the external gear box 126 away from the prime mover 110.

Figure 6:
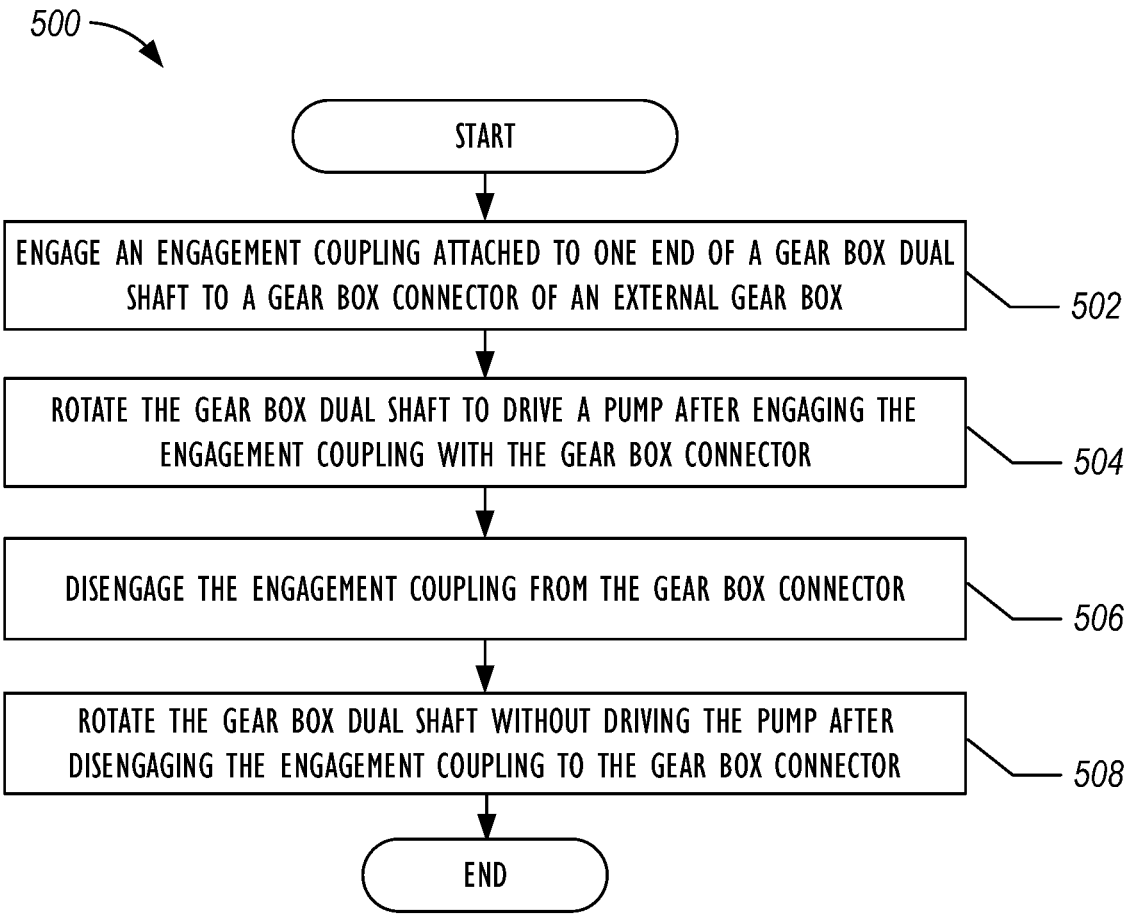
FIG. 6 is a flow chart of an embodiment of a method to engage and disengage an external gear box style pump from a prime mover for a fracturing pump transport.

FIG. 6 is a flow chart of an embodiment of a method 600 to engage and disengage an external gear box style pump from a prime mover for a fracturing pump transport. Method 600 may correspond to engaging and disengaging the engagement coupling 200 and gear box connector 130 shown in FIGS. 3A-3B. Additionally, the method 600 may also be implemented for engaging and disengaging the spline coupling 210 and spline hub 220 shown in FIGS. 4A-4B. The use and discussion of FIG. 6 is only an example to facilitate explanation and is not intended to limit the disclosure to this specific example.

Method 600 may start at block 602 by engaging an engagement coupling attached to one end of a gear box dual shaft to a gear box connector of an external gear box. To implement block 602, method 600 may utilize hydraulic or mechanical means to move the engagement coupling to an engagement position. In other implementations, method 600 may utilize electro-magnetic means to move the engagement coupling to the engagement position. Method 600 may then move to block 604 and rotate the gear box dual shaft to drive a pump after engaging the engagement coupling to the gear box connector. Using FIGS. 4A-4B as an example, engaging the spline coupling 210 with the spline hub 220, the rotational movement of the gear box dual shaft 128 transfers to the gear 130. Rotating the gear 130 drives the power end assembly 124 and the fluid end assembly 122 of the pump 120.

Method 600 continues to block 606 and disengages the engagement coupling from the gear box connector. In implementations where the engagement coupling is a spline coupling, then method 600 may perform a disengagement operation by moving the spline coupling away from the spline hub. Afterwards, method 600 moves to block 608 rotates the gear box dual shaft without driving the pump after disengaging the engagement coupling to the gear box connector. Using FIGS. 4A-4B, the gear box dual shaft 128 continues to rotate; however, since the gear box dual shaft does not internally couple or engage gear 130, the gear 130 does not rotate.

As used herein, the term "transport" refers to any transportation assembly, including, but not limited to, a trailer, truck, skid, rail car, and/or barge used to transport relatively heavy structures and/or other types of articles, such as fracturing equipment and fracturing sand. A transport can be independently movable from another transport. For example, a first transport can be mounted or connected to a motorized vehicle that independently moves the first transport while an unconnected second transport remains stationary.

As used herein, the term "trailer" refers to a transportation assembly used to transport relatively heavy structures and/or other types of articles (such as fracturing equipment and fracturing sand) that can be attached and/or detached from a transportation vehicle used to pull or tow the trailer. As an example, the transportation vehicle can independently move and tow a first trailer while an unconnected second trailer remains stationary. In one or more embodiments, the trailer includes mounts and manifold systems to connect the trailer to other fracturing equipment within a fracturing system or fleet. The term "lay-down trailer" refers to a specific embodiment of a trailer that includes two sections with different vertical heights. One of the sections or the upper section is positioned at or above the trailer axles and another section or the lower section is positioned at or below the trailer axles. In one embodiment, the main trailer beams of the lay-down trailer may be resting on the ground when in operational mode and/or when uncoupled from a transportation vehicle, such as a tractor.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations may be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). The use of the term "about" means±10% of the subsequent number, unless otherwise stated.

Use of the term "optionally" with respect to any element of a claim means that the element is required, or alternatively, the element is not required, both alternatives being within the scope of the claim. Use of broader terms such as comprises, includes, and having may be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise.

What is claimed is:

1. A fracturing transport, comprising:

a prime mover having a motor shaft and being operable to transmit drive to the motor shaft;

a first pump disposed adjacent the prime mover;

a first gear box connected to the first pump via a first gear, wherein the first gear box is an external gear box that includes a housing whose dimensions are disposed between a facing side of the prime mover that faces a facing side of the first pump and the facing side of the first pump, and wherein the housing defines a gap between the facing side of the first pump and a facing side of the housing that faces the facing side of the first pump;

a first gear shaft disposed on the first gear box; and a first coupling including first and second coupling elements disposed in the gap between the facing side of the housing and the facing side of the first pump, the first coupling being selectively coupleable between a coupled condition and an uncoupled condition, the first coupling in the coupled condition transferring the transmitted drive to the first gear of the first gear box by moving the first coupling element within the gap in a first direction toward the prime mover, and the first coupling in the uncoupled condition isolating the transmitted drive from the first gear of the first gear box by moving the first coupling element within the gap in a second direction toward the first pump and away from the prime mover.

2. The transport of claim 1, wherein the first pump comprises:

a power assembly coupled to the first gear of the first gear box to receive the transferred drive; and a fluid assembly driven by the power assembly and configured to pressurize fluid.

3. The fracturing transport of claim 1, wherein the prime mover comprises an electric motor or a hydrocarbon fuel-based motor.

4. The transport of claim 1, wherein the first coupling comprises a spline coupling, a clutch, an air clutch, an electro-magnetic clutch, a hydraulic clutch, or a plate clutch.

5. The transport of claim 1, wherein the first coupling comprises a plate clutch coupling disposed with a first end of the first gear shaft.

6. The transport of claim 1, wherein the first gear is coaxial with the first gear shaft, and in the uncoupled condition, the first gear shaft rotates based on the transmitted drive without rotating the first gear.

7. The transport of claim 1, wherein the first coupling comprises a first actuator engaged with the first coupling and configured to selectively couple the first coupling between the coupled and uncoupled conditions relative to the first gear box.

8. The transport of claim 7, further comprising a control system that is in communication with the first actuator and that transmits a signal to actuate the first actuator to selectively couple the first coupling relative to the first gear box.

9. The transport of claim 7, wherein the first actuator comprises a hydraulic piston, a pneumatic piston, an electric motor, or an electric solenoid.

10. The fracturing transport of claim 1, further comprising:

a second pump disposed adjacent the prime mover;

a second gear box connected to the second pump via a second gear;

a second gear shaft disposed on the second gear box and connected to the transmitted drive of the motor shaft; and a second coupling disposed between the second gear box and the second pump and being selectively coupleable between a coupled condition and an uncoupled condition, the second coupling in the coupled condition transferring the transmitted drive to the second gear of the second gear box, and the second coupling in the uncoupled condition isolating the transmitted drive from the second gear of the second gear box.

11. The transport of claim 10, wherein the second coupling comprises a second actuator engaged with the second coupling and configured to selectively couple the second coupling between the coupled and uncoupled conditions relative to the second gear box.

12. The transport of claim 10, wherein the first and second couplings are separately actuatable to selectively couple the respective coupling between the coupled and uncoupled conditions relative to the respective gear box.

13. The transport of claim 1, wherein:

the first coupling element is disposed on the first gear shaft and rotated with the first gear shaft;

the second coupling element is disposed on the first gear shaft and rotatable relative to the first gear shaft, the second coupling element connected by the first gear of the first gear box to the first pump for transferring the transmitted drive thereto; and a first actuator engaged with the first coupling element and being actuatable to selectively couple the first coupling element between the coupled and uncoupled conditions relative to the second coupling element.

14. The transport of claim 13, further comprising a bearing disposed between the first actuator and the first coupling element.

15. The transport of claim 13, wherein the first coupling element comprises a spline coupling being longitudinally movable along the first gear shaft relative to the second coupling element between the coupled and uncoupled conditions; and wherein the second coupling element comprises a spline hub being mated with the spline coupling in the coupled condition and being unmated with the spline coupling in the uncoupled condition.

16. The transport of claim 13, wherein the first actuator moves the first coupling element in at least one of the first and second directions.

17. The transport of claim 13, wherein the first coupling element is disposed between the second coupling element and the first pump, and wherein the second coupling element is disposed between the first coupling element and the first gear box.

18. The transport of claim 1, wherein the first coupling is disposed with the first gear shaft and is selectively coupleable between the coupled condition and the uncoupled condition relative to the first gear box, the first coupling in the coupled condition transferring the transmitted drive of the first gear shaft to the first gear of the first gear box, the first coupling in the uncoupled condition isolating the transmitted drive of the first gear shaft from the first gear of the first gear box.

19. The transport of claim 18, wherein the first gear shaft comprises first and second ends extending from opposite sides of the first gear box, the first end disposed toward the prime mover and connected to the motor shaft via a drive shaft, the second end having the first coupling.

20. The transport of claim 19, wherein the drive shaft has first and second ends, wherein the motor shaft is connected via a first hub to the first end of the drive shaft, and wherein the first end of the first gear shaft is connected via a second hub to the second end of the drive shaft.

21. A pump powered by transmitted drive of a prime mover to pump fluid, the pump comprising:

a fluid assembly configured to pressurize the fluid;

a power assembly coupled to the fluid assembly and transferring the transmitted drive to the fluid assembly;

a gear box coupled to the power assembly and transferring the transmitted drive to the power assembly via a gear of the gear box, wherein the gear box is an external gear box that includes a housing whose dimensions are disposed between a facing side of the prime mover that faces a facing side of the pump and the facing side of the pump, and wherein the housing defines a gap between the facing side of the pump and a facing side of the housing that faces the facing side of the pump;

a gear shaft disposed on the gear box, the gear shaft coupled to the prime mover and receiving the transmitted drive therefrom; and an engagement coupling including first and second coupling elements disposed in the gap between the facing side of the housing and the facing side of the pump, the engagement coupling being selectively coupleable between a coupled condition and an uncoupled condition relative to the gear box, the engagement coupling in the coupled condition transferring the transmitted drive of the gear shaft to the gear of the gear box by moving the first coupling element of the engagement coupling within the gap in a first direction toward the prime mover, and the engagement coupling in the uncoupled condition isolating the transmitted drive of the gear shaft from the gear of the gear box by moving the first coupling element within the gap in a second direction toward the power assembly and away from the prime mover.

22. The pump of claim 21, wherein the engagement coupling comprises an actuator engaged with the spline first coupling element and configured to selectively couple the engagement coupling between the coupled and uncoupled conditions relative to the gear box.

23. The pump of claim 21, wherein:

the second coupling element is a spline hub rotatable relative to the gear shaft and coupled to the gear of the gear box; and the first coupling element is a spline coupling rotating with the gear shaft and selectively mating with the spline hub.

24. The pump of claim 23, wherein the gear shaft comprises first and second ends extending from opposite sides of the gear box, the first end disposed toward the prime mover and connected to a motor shaft of the prime mover via a drive shaft, the second end having the spline coupling of the engagement coupling.

25. A method of pumping fracture fluid with a pump having a fluid end assembly powered by a power end assembly driven by a prime mover, the method comprising:

rotating a gear box shaft of a gear box coupled to the power end assembly by receiving drive from the prime mover at a first end of the gear box shaft, wherein the gear box is an external gear box that includes a housing whose dimensions are disposed between a facing side of the prime mover that faces a facing side of the pump and the facing side of the pump, and wherein the housing defines a gap between the facing side of the pump and a facing side of the housing that faces the facing side of the pump; and selectively transferring the received drive from the gear box shaft to a gear of the gear box by:

engaging an engagement coupling, disposed on a second end of the gear box shaft and in the gap between the facing side of the housing and the facing side of the pump, with the gear of the gear box and transmitting the rotation of the gear box shaft to the gear of the gear box by moving a coupling element of the engagement coupling within the gap in a first direction toward the prime mover, and disengaging the engagement coupling from the gear of the gear box and rotating the gear box shaft without transmission of the rotation to the gear of the gear box by moving the coupling element within the gap in a second direction toward the power end assembly and away from the prime mover.

26. The method of claim 25, wherein the engaging and disengaging of the engagement coupling from the gear of the gear box includes utilizing hydraulic power to move the engagement coupling.

* * * * *